US009898994B1

(12) United States Patent
Guo et al.

(10) Patent No.: US 9,898,994 B1
(45) Date of Patent: Feb. 20, 2018

(54) VOLTAGE GENERATION CIRCUIT AND LIQUID CRYSTAL TELEVISION

(71) Applicant: Shenzhen China Star Optoelectronics Technology Co., Ltd., Shenzhen, Guangdong (CN)

(72) Inventors: Dongsheng Guo, Guangdong (CN); Mingliang Wang, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 164 days.

(21) Appl. No.: 15/032,550

(22) PCT Filed: Feb. 3, 2016

(86) PCT No.: PCT/CN2016/073242

§ 371 (c)(1),
(2) Date: Apr. 27, 2016

(87) PCT Pub. No.: WO2017/120994

PCT Pub. Date: Jul. 20, 2017

(30) Foreign Application Priority Data

Jan. 15, 2016 (CN) ..... 2016 1 0028991

(51) Int. Cl.
*G09G 3/36* (2006.01)

(52) U.S. Cl.
CPC ..... *G09G 3/3696* (2013.01); *G09G 3/3688* (2013.01); *G09G 2310/08* (2013.01); *G09G 2320/041* (2013.01); *G09G 2330/021* (2013.01)

(58) Field of Classification Search
CPC ..... G09G 2330/02; G09G 3/3696; G09G 2330/021; G09G 2330/028; H04N 5/63
USPC ..... 345/52, 211; 348/730, 372; 399/37, 88, 399/89
See application file for complete search history.

(56) References Cited

U.S. PATENT DOCUMENTS 3,909,669 A * 9/1975 White ..... H05B 39/09 315/250
7,995,033 B2 * 8/2011 Chen ..... G06F 1/3203 315/169.1

(Continued)

FOREIGN PATENT DOCUMENTS

CN 1577476 A 2/2005
CN 1828472 A 9/2006

(Continued)

*Primary Examiner* — Koosha Sharifi-Tafreshi
(74) *Attorney, Agent, or Firm* — Andrew C. Cheng

(57) ABSTRACT

The present invention provides a voltage generation circuit, comprising a control unit, a controlled unit and an output unit, and the control unit receives a trigger signal to generate a control signal having a preset delay, and the control unit is further coupled to the controlled unit to control the controlled unit to be in a first state in a duration of the preset delay and to be in a second state in a duration of a non-preset delay, and the output unit outputs a first drive voltage to the drive unit as the controlled unit is in the first state and to output a second drive voltage to the drive unit as the controlled unit is in the second state, and the first drive voltage is smaller than the second drive voltage to achieve decreasing the drive voltage to lower power consumption of the data drive chip.

10 Claims, 2 Drawing Sheets

(56) References Cited

U.S. PATENT DOCUMENTS

| | | | | |
|---|---|---|---|---|
| 2010/0045647 | A1* | 2/2010 | Kim | G09G 3/3406 345/211 |
| 2011/0175892 | A1 | 7/2011 | Lee | |
| 2013/0127930 | A1 | 5/2013 | Nishio | |
| 2014/0300591 | A1 | 10/2014 | Aoki et al. | |

FOREIGN PATENT DOCUMENTS

| | | | |
|---|---|---|---|
| CN | 1889164 | A | 1/2007 |
| CN | 101075399 | A | 11/2007 |
| CN | 101363980 | A | 2/2009 |
| CN | 101419782 | A | 4/2009 |
| CN | 101800516 | A | 8/2010 |
| CN | 102831864 | A | 12/2012 |
| CN | 103810979 | A | 5/2014 |
| CN | 103871346 | A | 6/2014 |
| CN | 103903581 | A | 7/2014 |
| CN | 104103246 | A | 10/2014 |

* cited by examiner

VOLTAGE GENERATION CIRCUIT AND LIQUID CRYSTAL TELEVISION

CROSS REFERENCE

This application claims the priority of Chinese Patent Application No. 201610028991.3, entitled "Voltage generation circuit and liquid crystal television", filed on Jan. 15, 2016, the disclosure of which is incorporated herein by reference in its entirety.

FIELD OF THE INVENTION

The present invention relates to a display technology field, and more particularly to a voltage generation circuit and a liquid crystal television.

BACKGROUND OF THE INVENTION

The liquid crystal television has been widely applied due to it light weight, thin thickness and small power consumption. With the improvement of people's living standard, the large scale, high resolution, high frame rate liquid crystal television has become more and more popular. However, with the increase of these technical indexes, the power consumption of the data drive chip cooperated with the liquid crystal panel gets larger and larger, and the temperature is higher and higher. Therefore, how to reduce the power consumption of the data drive chip to lower the temperature is now pretty much the problem to be solved. At present, solving the problem can be achieved by increasing the chip size and adhering the cooling sheet. However, it correspondingly makes the entire cost tremendously increase.

SUMMARY OF THE INVENTION

The present invention provides a voltage generation circuit to reduce the temperature of the data drive chip of the liquid crystal television. The present invention further provides a liquid crystal television.

The present invention provides a voltage generation circuit, coupled to a drive unit of a data drive chip of a liquid crystal television to provide a drive voltage for the drive unit, and the voltage generation circuit comprises a control unit, a controlled unit and an output unit, and the control unit is employed to receive a trigger signal to generate a control signal having a preset delay, and the control unit is further coupled to the controlled unit to control the controlled unit to be in a first state in a duration of the preset delay with the control signal and to be in a second state in a duration of a non-preset delay, and the output unit is coupled between the controlled unit and the drive unit to output a first drive voltage to the drive unit as the controlled unit is in the first state and to output a second drive voltage to the drive unit as the controlled unit is in the second state, wherein the first drive voltage is smaller than the second drive voltage to achieve decreasing the drive voltage outputted to the drive unit to lower power consumption of the data drive chip.

The control unit comprises a first electrical switch, a first resistor, a second resistor, a first capacitor, a second capacitor and a timing chip, and a control end of the first electrical switch receives the trigger signal, and a first end of the first electrical switch is coupled to a voltage source with the second resistor, and is further coupled to a low trigger end of the timing chip, and a second of the first electrical switch is grounded, and a first end of the first resistor is coupled to the voltage source, and a second end of the first resistor is grounded with the first capacitor, and both a high trigger end and a discharge end of the timing chip are coupled to a node between the first resistor and the first capacitor, and a voltage end of the timing chip is coupled to the voltage source, and a reset end of the timing chip is coupled to the voltage source, and a control voltage end of the timing chip is grounded with the second capacitor, and a ground end of the timing chip is grounded, and an output end of the timing chip is coupled to the controlled unit to control the controlled unit to output the first drive voltage or the second drive voltage.

The output unit comprises a third resistor, a fourth resistor, a diode, an inductor and a pulse width modulation chip, and the third resistor and the fourth resistor are coupled in series between the output end of the controlled unit and a ground, and a feedback end of the pulse width modulation chip is coupled to a node between the third resistor and the fourth resistor, and an input end of the pulse width modulation chip is coupled to an input voltage source with the inductor, and is coupled to an anode of the diode, and a cathode of the diode is coupled to an output end of the controlled unit.

The controlled unit comprises a second electrical switch and a fifth resistor, and a control end of the second electrical switch is coupled to the output end of the timing chip, and a first end of the second electrical switch is coupled to a first end of the fifth resistor, and a second end of the fifth resistor is employed to be the output end of the controlled unit to be coupled to the drive unit to output a first output voltage or a second output voltage.

Both the first electrical switch and the second electrical switch are NPN type triodes, and control ends, first ends and second ends of the first electrical switch and the second electrical switch respectively are gates, drains and the sources of the triodes.

The present invention further provides a liquid crystal television, comprising a data drive chip and a voltage generation circuit, and the voltage generation circuit is coupled to a drive unit of a data drive chip of a liquid crystal television to provide a drive voltage for the drive unit, and the voltage generation circuit comprises a control unit, a controlled unit and an output unit, and the control unit is employed to receive a trigger signal to generate a control signal having a preset delay, and the control unit is further coupled to the controlled unit to control the controlled unit to be in a first state in a duration of the preset delay with the control signal and to be in a second state in a duration of a non-preset delay, and the output unit is coupled between the controlled unit and the drive unit to output a first drive voltage to the drive unit as the controlled unit is in the first state and to output a second drive voltage to the drive unit as the controlled unit is in the second state, wherein the first drive voltage is smaller than the second drive voltage to achieve decreasing the drive voltage outputted to the drive unit to lower power consumption of the data drive chip.

The control unit comprises a first electrical switch, a first resistor, a second resistor, a first capacitor, a second capacitor and a timing chip, and a control end of the first electrical switch receives the trigger signal, and a first end of the first electrical switch is coupled to a voltage source with the second resistor, and is further coupled to a low trigger end of the timing chip, and a second of the first electrical switch is grounded, and a first end of the first resistor is coupled to the voltage source, and a second end of the first resistor is grounded with the first capacitor, and both a high trigger end and a discharge end of the timing chip are coupled to a node between the first resistor and the first capacitor, and a voltage end of the timing chip is coupled to the voltage source, and a reset end of the timing chip is coupled to the voltage source, and a control voltage end of the timing chip is grounded with the second capacitor, and a ground end of the timing chip is grounded, and an output end of the timing chip is coupled to the controlled unit to control the controlled unit to output the first drive voltage or the second drive voltage.

The output unit comprises a third resistor, a fourth resistor, a diode, an inductor and a pulse width modulation chip, and the third resistor and the fourth resistor are coupled in series between the output end of the controlled unit and a ground, and a feedback end of the pulse width modulation chip is coupled to a node between the third resistor and the fourth resistor, and an input end of the pulse width modulation chip is coupled to an input voltage source with the inductor, and is coupled to an anode of the diode, and a cathode of the diode is coupled to an output end of the controlled unit.

The controlled unit comprises a second electrical switch and a fifth resistor, and a control end of the second electrical switch is coupled to the output end of the timing chip, and a first end of the second electrical switch is coupled to a first end of the fifth resistor, and a second end of the fifth resistor is employed to be the output end of the controlled unit to be coupled to the drive unit to output a first output voltage or a second output voltage.

The drive unit comprises an operational amplifier, a third transistor and a fourth transistor, and an input end of the operational amplifier is employed to coupled to a logic control module of the data drive chip, and an output end of the operational amplifier is coupled to gates of the third transistor and the fourth transistor, and a first end of the third transistor is coupled to the second end of the fifth resistor, and a second end of the third transistor is coupled to a first end of the fourth transistor, and a second end of the fourth transistor is grounded, and a node between the second end of the third transistor and the first end of the fourth transistor is coupled to a liquid crystal unit of the liquid crystal television to provide a liquid crystal voltage.

The present invention provides a voltage generation circuit, coupled to a drive unit of a data drive chip of a liquid crystal television to provide a drive voltage for the drive unit, and the voltage generation circuit comprises a control unit, a controlled unit and an output unit, and the control unit is employed to receive a trigger signal to generate a control signal having a preset delay, and the control unit is further coupled to the controlled unit to control the controlled unit to be in a first state in a duration of the preset delay with the control signal and to be in a second state in a duration of a non-preset delay, and the output unit is coupled between the controlled unit and the drive unit to output a first drive voltage to the drive unit as the controlled unit is in the first state and to output a second drive voltage to the drive unit as the controlled unit is in the second state, wherein the first drive voltage is smaller than the second drive voltage to achieve decreasing the drive voltage outputted to the drive unit to lower power consumption of the data drive chip. Therefore, the present invention realizes the objective of reducing the power consumption and the temperature of the data drive chip.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present invention, those of ordinary skill in this field can obtain other figures according to these figures without paying the premise.

DETAILED DESCRIPTION OF PREFERRED EMBODIMENTS

Embodiments of the present invention are described in detail with the technical matters, structural features, achieved objects, and effects with reference to the accompanying drawings as follows. It is clear that the described embodiments are part of embodiments of the present invention, but not all embodiments. Based on the embodiments of the present invention, all other embodiments to those of ordinary skill in the premise of no creative efforts obtained, should be considered within the scope of protection of the present invention.

Figure 1:
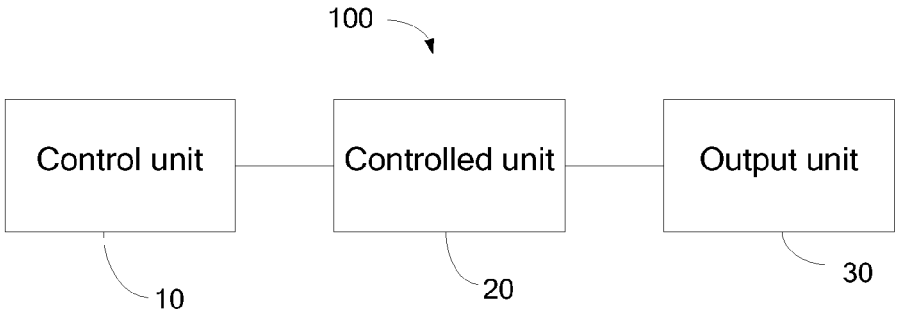
FIG. 1 is a block diagram of a voltage generation circuit provided by the first embodiment of the present invention.

Please refer to FIG. 1. The first embodiment of the present invention provides a voltage generation circuit 100. The voltage generation circuit 100 is coupled to a drive unit of a data drive chip of a liquid crystal television to provide a drive voltage for the drive unit. The voltage generation circuit 100 comprises a control unit 10, a controlled unit 20 and an output unit 30. The control unit 10 is employed to receive a trigger signal to generate a control signal having a preset delay. The control unit 10 is further coupled to the controlled unit 20 to control the controlled unit 20 to be in a first state in a duration of the preset delay with the control signal and to be in a second state in a duration of a non-preset delay. The output unit 30 is coupled between the controlled unit 20 and the drive unit to output a first drive voltage to the drive unit as the controlled unit 20 is in the first state and to output a second drive voltage to the drive unit as the controlled unit is in the second state. The first drive voltage is smaller than the second drive voltage to achieve decreasing the drive voltage outputted to the drive unit to lower power consumption of the data drive chip.

Specifically, the working voltage received by the drive unit is the second drive voltage in general. In this embodiment, in the charging moment, after the duration of preset delay, the working voltage received by the drive unit is the first drive voltage, and the first voltage is smaller than the second drive voltage. Thus, the initial charging current will be decreased, and the power consumption will be lowered. Consequently, the temperature of the data drive chip will be lowered along therewith.

Figure 2:
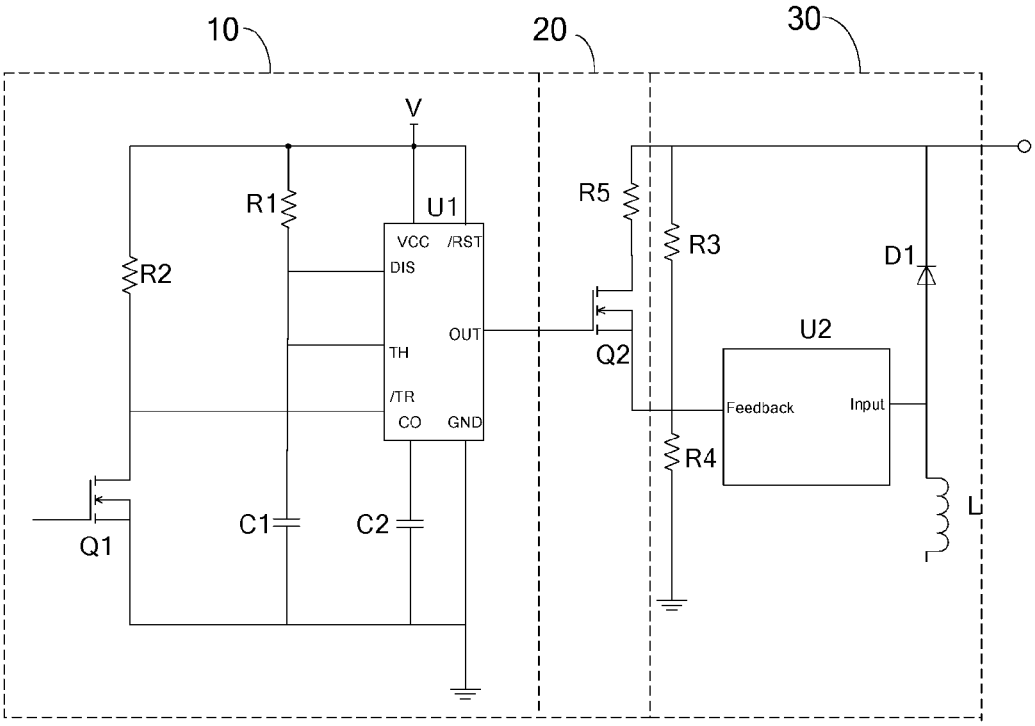
FIG. 2 is a circuit diagram of FIG. 1.

Please refer to FIG. 2. The control unit 10 comprises a first electrical switch Q1, a first resistor R1, a second resistor R2, a first capacitor C1, a second capacitor C2 and a timing chip U1. A control end of the first electrical switch Q1 receives the trigger signal. A first end of the first electrical switch Q1 is coupled to a voltage source with the second resistor R2, and is further coupled to a low trigger end /TR of the timing chip U1, and a second of the first electrical switch Q1 is grounded, and a first end of the first resistor R1 is coupled to the voltage source V, and a second end of the first resistor R1 is grounded with the first capacitor C1, and both a high trigger end TH and a discharge end DIS of the timing chip U1 are coupled to a node between the first resistor R1 and the first capacitor C1, and a voltage end VCC of the timing chip U1 is coupled to the voltage source V, and a reset end RES of the timing chip U1 is coupled to the voltage source V, and a control voltage end CO of the timing chip U1 is grounded with the second capacitor C2, and a ground end GND of the timing chip U1 is grounded, and an output end OUT of the timing chip U1 is coupled to the controlled unit 20 to control the controlled unit 20 to output the first drive voltage or the second drive voltage.

Significantly, the timing chip U1 is a 555 timing chip. The trigger signal is a TP pulse signal.

The output unit 30 comprises a third resistor R3, a fourth resistor R4, a diode D1, an inductor L and a pulse width modulation chip U2, and the third resistor R3 and the fourth resistor R4 are coupled in series between the output end of the controlled unit 20 and a ground. A feedback end Feedback of the pulse width modulation chip U2 is coupled to a node between the third resistor R3 and the fourth resistor R4. An input end Input of the pulse width modulation chip U2 is coupled to an input voltage source Vin with the inductor L, and is coupled to an anode of the diode D1. A cathode of the diode D1 is coupled to an output end of the controlled unit 20.

The controlled unit 20 comprises a second electrical switch Q2 and a fifth resistor R5. A control end of the second electrical switch Q2 is coupled to the output end OUT of the timing chip U1, and a first end of the second electrical switch Q2 is coupled to a first end of the fifth resistor R5, and a second end of the fifth resistor R5 is employed to be the output end of the controlled unit 20 to be coupled to the drive unit to output a first output voltage or a second output voltage.

Specifically, both the first electrical switch Q1 and the second electrical switch Q2 are NPN type triodes. Control ends, first ends and second ends of the first electrical switch Q1 and the second electrical switch Q2 respectively are gates, drains and the sources of the triodes. In other embodiments, the first electrical switch Q1 and the second electrical switch Q2 also can be transistors of other types according to the requirement.

The specific working principle is: after the trigger signal is inverted with the first electrical switch, the rigger signal is inputted to the low trigger end /TR of the timing chip U1. As the low trigger end /TR detects the low voltage level, the timing chip U1 outputs high voltage level to activate the second electrical switch Q2. Then, VAA1=VFB*(1+R5R3/R4(R5+R3)), and VAA voltage starts to decrease. After duration T=1.1*R1*C1, the timing chip U1 switches the high voltage to the low voltage level for outputting, and VAA2=VFB*(1+R2/R3), and the voltage starts to return to the normal level. The VAA1 is a first drive voltage; the VAA2 is a second drive voltage. Therefore, the initial drive voltage is decreased, and the initial current will be also decreased. Thus, the power consumption is lowered. Consequently, the temperature of the data drive chip will be lowered along therewith.

Specifically, with controlling the values of R1 and C1, the decreased duration of the first drive voltage can be controlled. With controlling the value of R5, the voltage reference level outputted by the drive circuit 30 can be controlled. Thereby, the setting of various degrees can be achieved.

Figure 3:
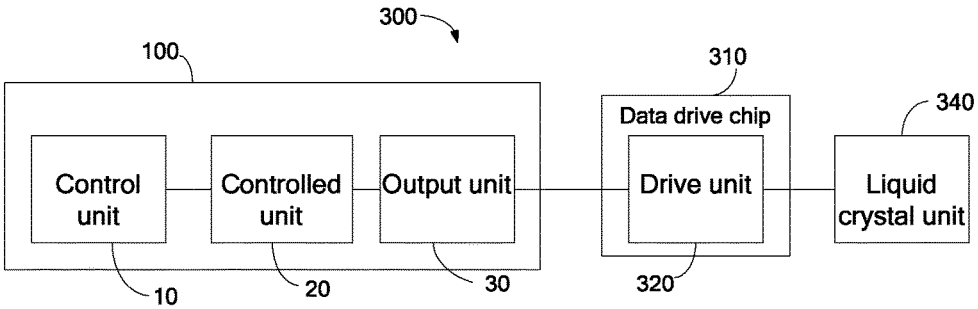
FIG. 3 is a block diagram of a liquid crystal television provided by the second embodiment of the present invention.

Please refer to FIG. 3. The second solution of the present invention further provides a liquid crystal television 300. The liquid crystal television 300 comprises a data drive chip 310 and a voltage generation circuit. The voltage generation circuit is the voltage generation circuit 100 provided in the aforesaid first solution.

Specifically, the voltage generation circuit 100 is coupled to a drive unit 320 of the data drive chip 310 to provide a drive voltage for the drive unit 320. The voltage generation circuit 100 comprises a control unit 10, a controlled unit 20 and an output unit 30. The control unit 10 is employed to receive a trigger signal to generate a control signal having a preset delay. The control unit 10 is further coupled to the controlled unit 20 to control the controlled unit 20 to be in a first state in a duration of the preset delay with the control signal and to be in a second state in a duration of a non-preset delay. The output unit 30 is coupled between the controlled unit 20 and the drive unit 320 to output a first drive voltage to the drive unit 320 as the controlled unit 20 is in the first state and to output a second drive voltage to the drive unit 320 as the controlled unit is in the second state. The first drive voltage is smaller than the second drive voltage to achieve decreasing the drive voltage outputted to the drive unit 320 to lower power consumption of the data drive chip.

Specifically, the working voltage received by the drive unit 320 is the second drive voltage in general. In this embodiment, in the charging moment, after the duration of preset delay, the working voltage received by the drive unit 320 is the first drive voltage, and the first voltage is smaller than the second drive voltage. Thus, the initial charging current will be decreased, and the power consumption will be lowered. Consequently, the temperature of the data drive chip will be lowered along therewith.

Figure 4:
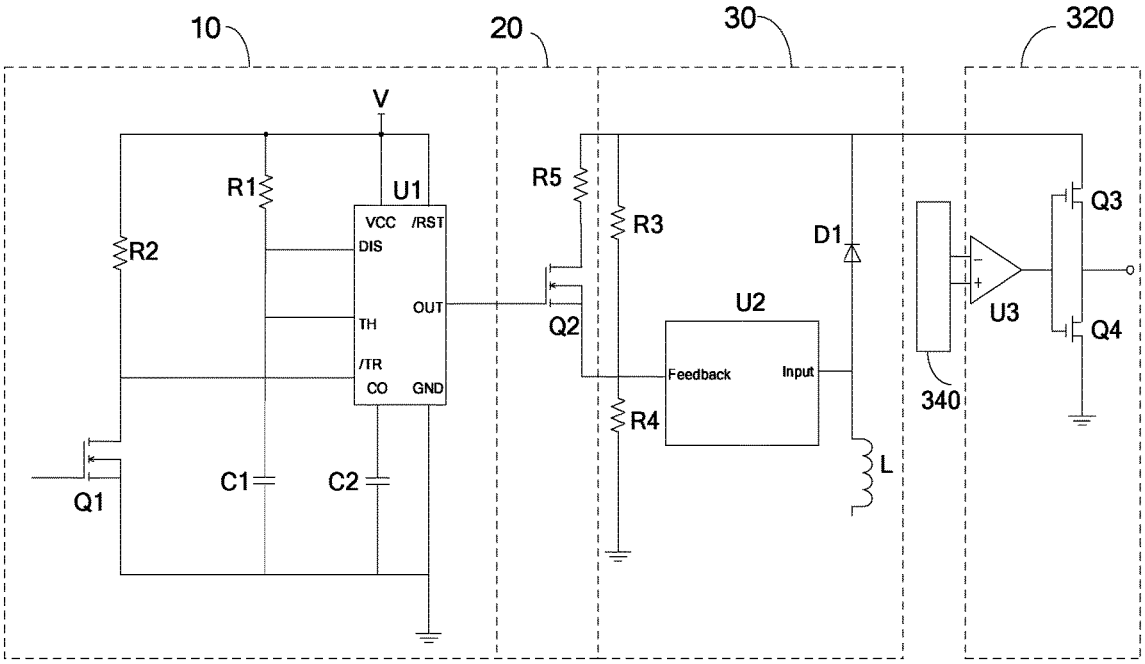
FIG. 4 is a circuit diagram of FIG. 3.

Please refer to FIG. 4. The control unit 10 comprises a first electrical switch Q1, a first resistor R1, a second resistor R2, a first capacitor C1, a second capacitor C2 and a timing chip U1. A control end of the first electrical switch Q1 receives the trigger signal. A first end of the first electrical switch Q1 is coupled to a voltage source with the second resistor R2, and is further coupled to a low trigger end /TR of the timing chip U1, and a second of the first electrical switch Q1 is grounded, and a first end of the first resistor R1 is coupled to the voltage source V, and a second end of the first resistor R1 is grounded with the first capacitor C1, and both a high trigger end TH and a discharge end DIS of the timing chip U1 are coupled to a node between the first resistor R1 and the first capacitor C1, and a voltage end VCC of the timing chip U1 is coupled to the voltage source V, and a reset end RES of the timing chip U1 is coupled to the voltage source V, and a control voltage end CO of the timing chip U1 is grounded with the second capacitor C2, and a ground end GND of the timing chip U1 is grounded, and an output end OUT of the timing chip U1 is coupled to the controlled unit 20 to control the controlled unit 20 to output the first drive voltage or the second drive voltage.

Significantly, the timing chip U1 is a 555 timing chip. The trigger signal is a TP pulse signal.

The output unit 30 comprises a third resistor R3, a fourth resistor R4, a diode D1, an inductor L and a pulse width modulation chip U2, and the third resistor R3 and the fourth resistor R4 are coupled in series between the output end of the controlled unit 20 and a ground. A feedback end Feedback of the pulse width modulation chip U2 is coupled to a node between the third resistor R3 and the fourth resistor R4. An input end Input of the pulse width modulation chip U2 is coupled to an input voltage source Vin with the inductor L, and is coupled to an anode of the diode D1. A cathode of the diode D1 is coupled to an output end of the controlled unit 20.

The controlled unit 20 comprises a second electrical switch Q2 and a fifth resistor R5. A control end of the second electrical switch Q2 is coupled to the output end OUT of the timing chip U1, and a first end of the second electrical switch Q2 is coupled to a first end of the fifth resistor R5, and a second end of the fifth resistor R5 is employed to be the output end of the controlled unit 20 to be coupled to the drive unit 320 to output a first output voltage or a second output voltage.

The drive unit 320 comprises an operational amplifier U3, a third transistor Q3 and a fourth transistor Q4. An input end of the operational amplifier U3 is employed to coupled to a logic control module 330 of the data drive chip 310. An output end of the operational amplifier U3 is coupled to gates of the third transistor Q3 and the fourth transistor Q4, and a first end of the third transistor Q3 is coupled to the second end of the fifth resistor R5, and a second end of the third transistor Q3 is coupled to a first end of the fourth transistor Q4. A second end of the fourth transistor Q4 is grounded. A node between the second end of the third transistor Q3 and the first end of the fourth transistor Q4 is coupled to a liquid crystal unit 340 of the liquid crystal television to provide a liquid crystal voltage.

Specifically, both the first electrical switch Q1 and the second electrical switch Q2 are NPN type triodes. Control ends, first ends and second ends of the first electrical switch Q1 and the second electrical switch Q2 respectively are gates, drains and the sources of the triodes. In other embodiments, the first electrical switch Q1 and the second electrical switch Q2 also can be transistors of other types according to the requirement.

The specific working principle is: after the trigger signal is inverted with the first electrical switch, the rigger signal is inputted to the low trigger end /TR of the timing chip U1. As the low trigger end /TR detects the low voltage level, the timing chip U1 outputs high voltage level to activate the second electrical switch Q2. Then, VAA1=VFB*(1+R5R3/R4(R5+R3)), and VAA voltage starts to decrease. After duration T=1.1*R1*C1, the timing chip U1 switches the high voltage to the low voltage level for outputting, and VAA2=VFB*(1+R2/R3), and the voltage starts to return to the normal level. The VAA1 is a first drive voltage; the VAA2 is a second drive voltage. Therefore, the initial drive voltage is decreased, and the initial current will be also decreased. Thus, the power consumption is lowered. Consequently, the temperature of the data drive chip will be lowered along therewith.

Specifically, with controlling the values of the first resistor R1 and the first capacitor C1, the decreased duration of the first drive voltage can be controlled. With controlling the value of the fifth resistor R5, the voltage reference level outputted by the drive circuit 30 can be controlled. Thereby, the setting of various degrees can be achieved.

Above are embodiments of the present invention, which does not limit the scope of the present invention. Any modifications, equivalent replacements or improvements within the spirit and principles of the embodiment described above should be covered by the protected scope of the invention.

What is claimed is:

1. A voltage generation circuit, coupled to a drive unit of a data drive chip of a liquid crystal television to provide a drive voltage for the drive unit, and the voltage generation circuit comprises a control unit, a controlled unit and an output unit, and the control unit is employed to receive a trigger signal to generate a control signal having a preset delay, and the control unit is further coupled to the controlled unit to control the controlled unit to be in a first state in a duration of the preset delay with the control signal and to be in a second state in a duration of a non-preset delay, and the output unit is coupled between the controlled unit and the drive unit to output a first drive voltage to the drive unit as the controlled unit is in the first state and to output a second drive voltage to the drive unit as the controlled unit is in the second state, wherein the first drive voltage is smaller than the second drive voltage to achieve decreasing the drive voltage outputted to the drive unit to lower power consumption of the data drive chip.

2. The voltage generation circuit according to claim 1, wherein the control unit comprises a first electrical switch, a first resistor, a second resistor, a first capacitor, a second capacitor and a timing chip, and a control end of the first electrical switch receives the trigger signal, and a first end of the first electrical switch is coupled to a voltage source with the second resistor, and is further coupled to a low trigger end of the timing chip, and a second of the first electrical switch is grounded, and a first end of the first resistor is coupled to the voltage source, and a second end of the first resistor is grounded with the first capacitor, and both a high trigger end and a discharge end of the timing chip are coupled to a node between the first resistor and the first capacitor, and a voltage end of the timing chip is coupled to the voltage source, and a reset end of the timing chip is coupled to the voltage source, and a control voltage end of the timing chip is grounded with the second capacitor, and a ground end of the timing chip is grounded, and an output end of the timing chip is coupled to the controlled unit to control the controlled unit to output the first drive voltage or the second drive voltage.

3. The voltage generation circuit according to claim 2, wherein the output unit comprises a third resistor, a fourth resistor, a diode, an inductor and a pulse width modulation chip, and the third resistor and the fourth resistor are coupled in series between the output end of the controlled unit and a ground, and a feedback end of the pulse width modulation chip is coupled to a node between the third resistor and the fourth resistor, and an input end of the pulse width modulation chip is coupled to an input voltage source with the inductor, and is coupled to an anode of the diode, and a cathode of the diode is coupled to an output end of the controlled unit.

4. The voltage generation circuit according to claim 3, wherein the controlled unit comprises a second electrical switch and a fifth resistor, and a control end of the second electrical switch is coupled to the output end of the timing chip, and a first end of the second electrical switch is coupled to a first end of the fifth resistor, and a second end of the fifth resistor is employed to be the output end of the controlled unit to be coupled to the drive unit to output a first output voltage or a second output voltage.

5. The voltage generation circuit according to claim 4, wherein both the first electrical switch and the second electrical switch are NPN type triodes, and control ends, first ends and second ends of the first electrical switch and the second electrical switch respectively are gates, drains and the sources of the triodes.

6. A liquid crystal television, comprising a data drive chip and a voltage generation circuit, and the voltage generation circuit is coupled to a drive unit of a data drive chip of a liquid crystal television to provide a drive voltage for the drive unit, and the voltage generation circuit comprises a control unit, a controlled unit and an output unit, and the control unit is employed to receive a trigger signal to generate a control signal having a preset delay, and the control unit is further coupled to the controlled unit to control the controlled unit to be in a first state in a duration of the preset delay with the control signal and to be in a second state in a duration of a non-preset delay, and the output unit is coupled between the controlled unit and the drive unit to output a first drive voltage to the drive unit as the controlled unit is in the first state and to output a second drive voltage to the drive unit as the controlled unit is in the second state, wherein the first drive voltage is smaller than the second drive voltage to achieve decreasing the drive voltage outputted to the drive unit to lower power consumption of the data drive chip.

7. The liquid crystal television according to claim 6, wherein the control unit comprises a first electrical switch, a first resistor, a second resistor, a first capacitor, a second capacitor and a timing chip, and a control end of the first electrical switch receives the trigger signal, and a first end of the first electrical switch is coupled to a voltage source with the second resistor, and is further coupled to a low trigger end of the timing chip, and a second of the first electrical switch is grounded, and a first end of the first resistor is coupled to the voltage source, and a second end of the first resistor is grounded with the first capacitor, and both a high trigger end and a discharge end of the timing chip are coupled to a node between the first resistor and the first capacitor, and a voltage end of the timing chip is coupled to the voltage source, and a reset end of the timing chip is coupled to the voltage source, and a control voltage end of the timing chip is grounded with the second capacitor, and a ground end of the timing chip is grounded, and an output end of the timing chip is coupled to the controlled unit to control the controlled unit to output the first drive voltage or the second drive voltage.

8. The liquid crystal television according to claim 7, wherein the output unit comprises a third resistor, a fourth resistor, a diode, an inductor and a pulse width modulation chip, and the third resistor and the fourth resistor are coupled in series between the output end of the controlled unit and a ground, and a feedback end of the pulse width modulation chip is coupled to a node between the third resistor and the fourth resistor, and an input end of the pulse width modulation chip is coupled to an input voltage source with the inductor, and is coupled to an anode of the diode, and a cathode of the diode is coupled to an output end of the controlled unit.

9. The liquid crystal television according to claim 8, wherein the controlled unit comprises a second electrical switch and a fifth resistor, and a control end of the second electrical switch is coupled to the output end of the timing chip, and a first end of the second electrical switch is coupled to a first end of the fifth resistor, and a second end of the fifth resistor is employed to be the output end of the controlled unit to be coupled to the drive unit to output a first output voltage or a second output voltage.

10. The liquid crystal television according to claim 9, wherein the drive unit comprises an operational amplifier, a third transistor and a fourth transistor, and an input end of the operational amplifier is employed to coupled to a logic control module of the data drive chip, and an output end of the operational amplifier is coupled to gates of the third transistor and the fourth transistor, and a first end of the third transistor is coupled to the second end of the fifth resistor, and a second end of the third transistor is coupled to a first end of the fourth transistor, and a second end of the fourth transistor is grounded, and a node between the second end of the third transistor and the first end of the fourth transistor is coupled to a liquid crystal unit of the liquid crystal television to provide a liquid crystal voltage.

* * * * *